US006350193B1

(12) United States Patent
Paulsen

(10) Patent No.: US 6,350,193 B1
(45) Date of Patent: Feb. 26, 2002

(54) COIN HOPPER COIN FEEDER MECHANISM

(75) Inventor: Craig A. Paulsen, Reno, NV (US)

(73) Assignee: International Game Technology, Reno, NV (US)

( * ) Notice: Subject to any disclaimer, the term of this patent is extended or adjusted under 35 U.S.C. 154(b) by 0 days.

(21) Appl. No.: 09/617,482

(22) Filed: Jul. 17, 2000

(51) Int. Cl.[7] ..... G07D 1/00
(52) U.S. Cl. ..... 453/57
(58) Field of Search ..... 453/29, 49, 53

(56) References Cited

U.S. PATENT DOCUMENTS 3,942,544 A 3/1976 Breitenstein et al.
4,004,598 A * 1/1977 Bezsilko ..... 453/57
4,036,242 A * 7/1977 Breitenstein et al. ..... 453/57 X
5,205,780 A * 4/1993 Rasmussen ..... 453/57 X
5,516,293 A 5/1996 Heidel et al. ..... 453/32
6,003,651 A 12/1999 Waller et al. ..... 194/202

* cited by examiner

*Primary Examiner*—James R. Bidwell
(74) *Attorney, Agent, or Firm*—Weide & Miller, Ltd.

(57) ABSTRACT

A coin feeder mechanism for transporting coins from a coin hopper is disclosed. The coin feeder mechanism includes a shelfwheel having a peripheral edge, a pinwheel having a front face and a peripheral edge, and a plurality of pins extending from the front face of the pinwheel between the peripheral edge of the pinwheel and the peripheral edge of the shelfwheel. The pinwheel is rotatably mounted with respect to the shelfwheel and positioned adjacent thereto. The shelfwheel has a coin pick-up area and a coin delivery area. The peripheral edge of the shelfwheel is farther away from pins associated with the pinwheel at the coin pick-up area than at the coin delivery area. In one embodiment, the arrangement of the shelfwheel and pinwheel is accomplished by mounting the shelfwheel so that a center thereof is offset vertically upwardly from a center of the pinwheel.

20 Claims, 3 Drawing Sheets

COIN HOPPER COIN FEEDER MECHANISM

FIELD OF THE INVENTION

The present invention relates to coin hopper payout mechanisms, and more particularly those which utilize a coin feeding wheel and knife mechanism.

BACKGROUND OF THE INVENTION

A wide variety of devices are arranged to dispense to a user of the device one or more coins. Exemplary of such devices are gaming machines. These machines are often arranged to pay winnings to a player in the form of one or more coins.

The purpose of providing such a machine with a coin paying mechanism is to automate the machine. With respect to a gaming machine, this automation reduces the cost associated with operating the game, such as by reducing the number of persons needed to operate the game. The automation has the added advantage to the player that the player is immediately paid winnings. The success of this automation is tied to the reliability of the coin paying mechanism. If the coin paying mechanism is not reliable, the game will be inoperable. When the game is inoperable, players can not play it and the gaming operator loses revenue. In addition, the gaming operator must spend money servicing the game.

Present coin paying mechanisms suffer from reliability problems arising from coin jams. During the coin feeding process, one or more coins become jammed in the feeding mechanism. This delays payment to the player, makes tracking correct payouts difficult, and necessitates servicing of the gaming machine.

FIG. 1 illustrates an arrangement of a coin feeding mechanism of the prior art. The coin feeding mechanism 20 comprises a pinwheel 22 and a shelfwheel 24 arranged to rotate with one another with respect to a support 26. The pinwheel 22 comprises a circular disk having a plurality of pins 28 extending outwardly from a front face thereof. The spacing of the pins 28 and their distance from the shelfwheel 24 is dependent upon the size of the coin which is to be fed.

The shelfwheel 24 also comprises a circular disk. The shelfwheel 24 is mounted at a front face of the pinwheel 22. The shelfwheel 24 has a perimeter which defines a ledge 30 upon which coins rest. The pinwheel 22 and shelfwheel 24 are arranged to rotate with one another in a counter-clockwise direction. Generally, the pinwheel 22 and shelfwheel 24 are mounted to a drive shaft which is driven by an electric motor.

A knife 32 is provided for removing coins from the shelfwheel 24. The knife 32 rests upon or is positioned very close to the peripheral edge of the shelfwheel 24, and has a surface which directs the coins from the shelfwheel 24 to a coin deliver chute or other coin delivery pathway.

As illustrated, the pinwheel 22 and shelfwheel 24 are concentric. That is, the axis about which both the pinwheel 22 and shelfwheel 24 rotate is the same. In this arrangement, the distance between the perimeter ledge 30 of the shelfwheel 24 and the pins 28 of the pinwheel 22 is constant about the circumference of the pinwheel 22.

Operation of the prior art coin feeder mechanism is as follows. Coins 34 in a hopper (not shown) are picked up by the feeder mechanism at the lower portion thereof. In particular, coins 34 are caught by the passing pins 28 as they pass through the coins in the hopper. The pins 28 are positioned such that one coin 34 will fit between each pair of pins 28.

The pins 28 and shelfwheel 24 support the coins as they move counter-clockwise. Once the coins 34 reach the top of the mechanism, they are removed from the shelfwheel 24 by the knife 32. The coins are then directed as desired along a coin dispensing pathway.

There are several problems associated with such a prior art coin feeding mechanism. First, the mechanism is not extremely efficient in picking up the coins from the hopper. In other words, in some instances, the space between pairs of pins 28 is not filled with a coin 32 as the mechanism rotates. Because a portion of the spaces are empty, the time necessary to dispense a given number of coins is increased. When the number of coins to be dispensed is large, this slows the operation of the machine, and thus lessens the time a player is gambling, in the case of a gaming machine.

More significantly, the coin feeding mechanism is prone to jams. As the coins move from the shelfwheel 24 to the knife 32, they often become stuck, stopping the rotation of the pinwheel 22 and shelfwheel 24. The machine must then be serviced in order to place it back in operation.

An improved coin feeder mechanism for a coin hopper which overcomes the above-stated problems is desired.

SUMMARY OF THE INVENTION

The present invention is a coin feeder mechanism for transporting coins from a coin hopper. The coin feeder mechanism is arranged to improve coin pick up from the hopper and reduce the probability of coin jamming at delivery.

In one embodiment, the coin feeder mechanism includes a shelfwheel having a peripheral edge, a pinwheel having a front face and a peripheral edge, and a plurality of pins extending from the front face of the pinwheel between the peripheral edge of the pinwheel and the peripheral edge of the shelfwheel. The pinwheel is rotatably mounted with respect to the shelfwheel and positioned adjacent thereto. The shelfwheel has a coin pick-up area and a coin delivery area. The peripheral edge of the shelfwheel at the coin pick-up area is farther away from pins associated with the pinwheel in that area than is the peripheral edge of the shelfwheel to pins associated with the pinwheel at the coin delivery area.

In a preferred embodiment, the arrangement of the shelfwheel with respect to the pins of the pinwheel comprises mounting the shelfwheel in an offset arrangement with respect to the pinwheel. In one embodiment, the pinwheel and shelfwheel are generally circular, with the center of the shelfwheel offset vertically upward from the center of the pinwheel.

In one embodiment, the pinwheel is mounted on a drive shaft which is rotated. The shelfwheel is mounted stationary on the drive shaft with a bearing. The shelfwheel includes a mounting arm connected to a support structure of the mechanism for maintaining the shelfwheel fixed in position as the drive shaft is rotated.

The coin feeder mechanism includes a knife having a portion which engages the shelfwheel. The knife directs coins from the shelfwheel to another location as they are fed from the coin hopper. In one embodiment, the knife is integrally formed with the shelfwheel.

In accordance with the invention, when a pin engages a coin at the pick-up area, the pin is positioned with respect to the shelfwheel such that the pin engages the coin in a manner in which the coin is both lifted upwardly and moved horizontally. As the coin is transported around the shelfwheel by the pin on the pinwheel, the position of the pin with respect to the coin is such that the pin serves to cradle the coin and maintain it in position. At the point where the coin is delivered from the shelfwheel, the position of the pin with respect to the coin is such that the pin acts to push the coin out of contact with the shelfwheel, and not downwardly, lessening the probability of coin jamming.

Further objects, features, and advantages of the present invention over the prior art will become apparent from the detailed description of the drawings which follows, when considered with the attached figures.

DETAILED DESCRIPTION OF THE INVENTION

The invention is a coin feeder mechanism for a coin hopper. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention. Features of the invention may be utilized alone or in combination with other elements.

In general, the present invention is a coin feeder mechanism for feeding or delivering coins from a coin hopper to another location. The coin feeder mechanism is arranged to increase the rate of coin pick-up from the hopper and to reduce the occurrence of coin jams.

Figure 3:
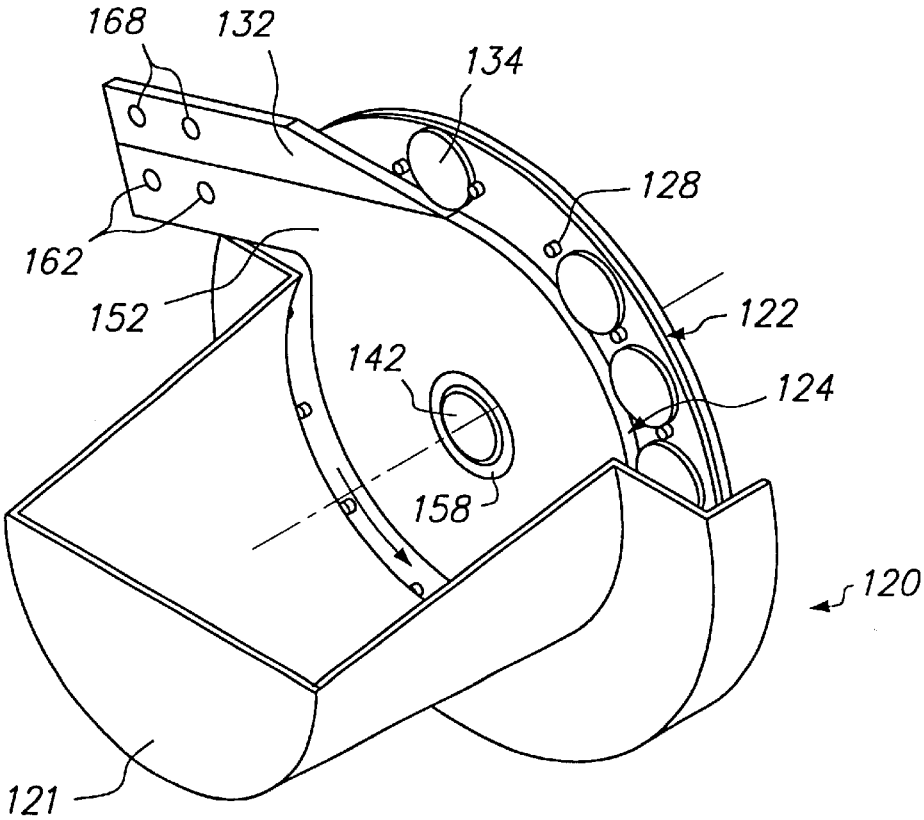
FIG. 3 is a perspective view of a coin feeder mechanism for a coin hopper in accordance with the present invention.

The invention will now be described in more detail with reference first to FIGS. 3 and 4. Illustrated therein is a coin feeder mechanism 120. The coin feeder mechanism 120 may be adapted for a number of uses, but is particularly suited for use in feeding coins from a coin hopper 121 (see FIG. 3). Such coin hoppers, including their configuration and operation, are well known to those of skill in the art.

The coin feeder mechanism 120 includes a pinwheel 122. The pinwheel 122 preferably comprises a generally circular disc. As best illustrated in FIG. 4, the disc has a front or first face or side 136, a rear or second face or side 138, and an outer peripheral edge 140. The front and rear faces 136, 138 are generally planar, except for a plurality of pins 128 extending from the front face 136. The pins 128 are positioned near the peripheral edge 140 of the front face 136. The particular spacing of the pins 128, including their radial distance inwardly from the peripheral edge 140, is dependent upon the size of coins to be transported by the feeder mechanism 120. In general, the larger the size of the coin to be transported, the closer each pin 128 is to the peripheral edge 140 of the pinwheel 122, and the farther the pins are apart from one another. Preferably, the pins 128 are all positioned approximately the same radial distance from a center of the pinwheel 122 for a particular size of coin to be transported. Of course, when the pins 128 are spaced farther apart to accommodate large coins, there are fewer pins 128 on the pinwheel 122 than when the pins 128 are arranged to transport smaller coins and they are located closer to one another.

Preferably, the pinwheel 122 is constructed of a durable material, such as metal. The pinwheel 122 may be cast, machined or otherwise formed. Preferably, the pins 128 are formed integrally with the pinwheel 122 for strength, but they may be formed separately and attached thereto.

Figure 4:
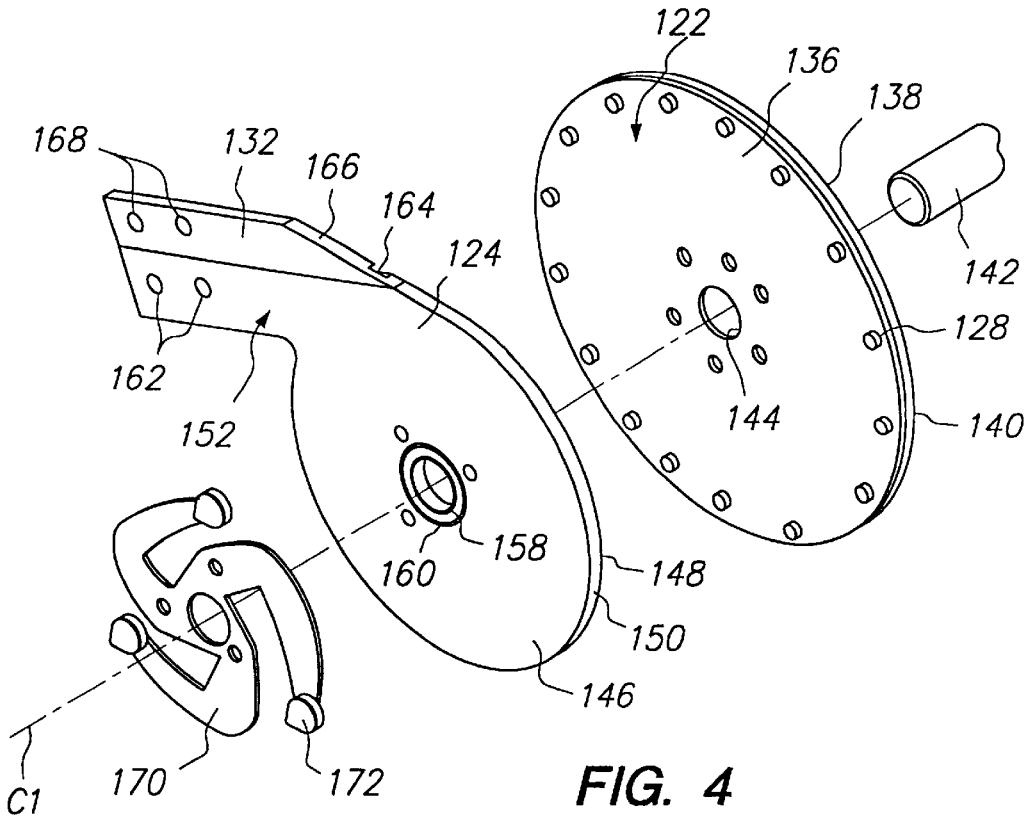
FIG. 4 is an exploded perspective view of an embodiment coin feeder mechanism in accordance with the present invention.

As illustrated in FIG. 4, a centerline C1 passes through the pinwheel 122 perpendicular to its front and rear faces 136,138. A drive mechanism is provided for rotating the pinwheel 122 about the centerline C1. In the embodiment illustrated, the drive mechanism includes a drive shaft 142. Means are provided for rotating the drive shaft 142. In one or more embodiments, the drive means may comprise an electric motor (not shown). As will be appreciated by those of skill in the art, a wide variety of drive means may be employed, and the means may be arranged to drive the drive shaft 142 either directly or indirectly. In addition, in one or more embodiments, the drive mechanism may be arranged to drive the pinwheel 122 directly, without the drive shaft. For example, a motor having a geared output shaft may be arranged to directly contact and drive a gear mounted to the pinwheel or engage teeth provided on the pinwheel 122.

In the illustrated embodiment, the pinwheel 122 includes a central bore 144 for accepting the drive shaft 142. The pinwheel 122 is mounted to the drive shaft 142 for rotation by the drive shaft 142. The pinwheel 122 may be press-fit onto the drive shaft 142, or bolted, keyed or otherwise fixed or removably fixed to the drive shaft 142.

Referring to FIG. 4, the coin feeder mechanism 120 includes a shelfwheel 124. The shelfwheel 124 comprises a generally circular disc. The shelfwheel 124 has a front or first face or side 146, a rear or second face or side 148 and peripheral edge 150. The thickness of the shelfwheel 124, at least at the peripheral edge 150, is sufficient to support a coin thereon.

In a preferred embodiment, the shelfwheel 124 is generally circular, except for a mounting arm 152. As described below, the shelfwheel 124 need not be circular, but it is desirable for the peripheral edge thereof, at least in the area over which coins are transported, to be smooth and arcuate in shape. The shelfwheel 124 is arranged to remain stationary with respect to the pinwheel 122, but is mounted adjacent thereto for cooperation with the pinwheel 122 in transporting coins.

The shelfwheel 124 may be constructed from a wide variety of materials and in a wide variety of manners. Preferably, the shelfwheel 124 is constructed of a durable and rigid material such as metal.

In a preferred embodiment, the shelfwheel 124 is supported in part by the drive shaft 142. In order for the shelfwheel 124 to be mounted on the drive shaft 142, but not be driven by the drive shaft 142, the shelfwheel 124 is mounted on a bearing 158 positioned on the drive shaft 142. As illustrated, the shelfwheel 124 includes a generally circular passage 160 therethrough. In a preferred embodiment, the bearing 158 is annular, and mounted within the passage 160. The bearing 158 itself defines a passage for accepting the drive shaft 142.

The mounting arm 152 is mounted to a stationary member, such as a frame or support member (not shown), which frame or support is stationary with respect to the pinwheel 122. In this regard, the mounting arm 152 extends radially outward from the main, circular portion of the shelfwheel 124. A distal portion of the mounting arm 152 includes a pair of bores 162 for accepting mounting bolts or other means for affixing the mounting arm 152 to a support structure.

As described above, the shelfwheel 124 is mounted adjacent to the pinwheel 122. In a preferred embodiment, a bearing surface (not shown) is provided for permitting the pinwheel 122 to rotate with respect to the shelfwheel 124 with a minimum amount of wear and friction. In addition, in such a configuration, there is little or no gap between the shelfwheel 124 and pinwheel 122 in which coins might fall or become jammed. In another embodiment, the shelfwheel 124 may simply be spaced slightly from the pinwheel 122, with the spacing between the pinwheel 122 and shelfwheel 124 being less than the thickness of a coin which is to be transported by the coin feeder mechanism 120 to prevent coins from becoming lodged between the pinwheel 122 and shelfwheel 124.

The coin feeder mechanism 120 includes a knife 132 for use in removing coins from the shelfwheel 124 as they are transported thereby. The knife 132 may have a variety of configurations as known in the prior art. The knife 132 includes a coin transporting surface 166. This surface 166 is adapted to direct the coins from the peripheral edge 150 of the shelfwheel 124, as is described in more detail below.

In one or more embodiments, the knife 132 includes a pair of mounting holes 168 for mounting the knife 132 to a support. The particular mounting arrangement for the knife 132 may vary. For example, the knife 132 may be formed integrally with the shelfwheel 124.

In one embodiment, a slot 164 is provided in the rear surface of the knife 132. The slot 164 is adapted to permit the passage of the pins 128 as the pinwheel 122 rotates with respect to the shelfwheel 124. As illustrated, the slot 164 is a generally narrow, arcuate channel formed in the knife 132. The slot 164 may have a variety of shapes and sizes.

Importantly, the shelfwheel 124 has a specific orientation with respect to the pinwheel 122. In general, the shelfwheel 124/pinwheel 122 arrangement is such that the peripheral edge 150 of the shelfwheel 124 is closer to the pins 128 (and thus the peripheral edge 140 of the pinwheel 122) at a top portion of the coin feeder mechanism 120 than at a bottom portion of the coin feeder mechanism. 120. Such a configuration has the advantage, as described below, of improving coin pick-up efficiency and reducing jamming. As referred to herein, a bottom portion of the mechanism 120 generally refers to an area near the hopper where coins are picked up (i.e. a "coin pick-up area"), and the top portion generally refers to an area opposite therefrom, and more particularly that area near where the knife 132 engages the shelfwheel 124 (i.e. a "coin delivery area"). It will be appreciated that these areas do not necessarily comprise a specific point, but comprise a region, the position of which may vary depending upon the arrangement/orientation of the mechanism 120.

In a preferred embodiment, this is accomplished as described below. Referring to FIG. 4, when the shelfwheel 124 is mounted on the drive shaft 142 as described above, the axis C1 passes through the opening 160 in the shelfwheel 124, perpendicular to the front and rear surfaces 146,148.

Figure 5:
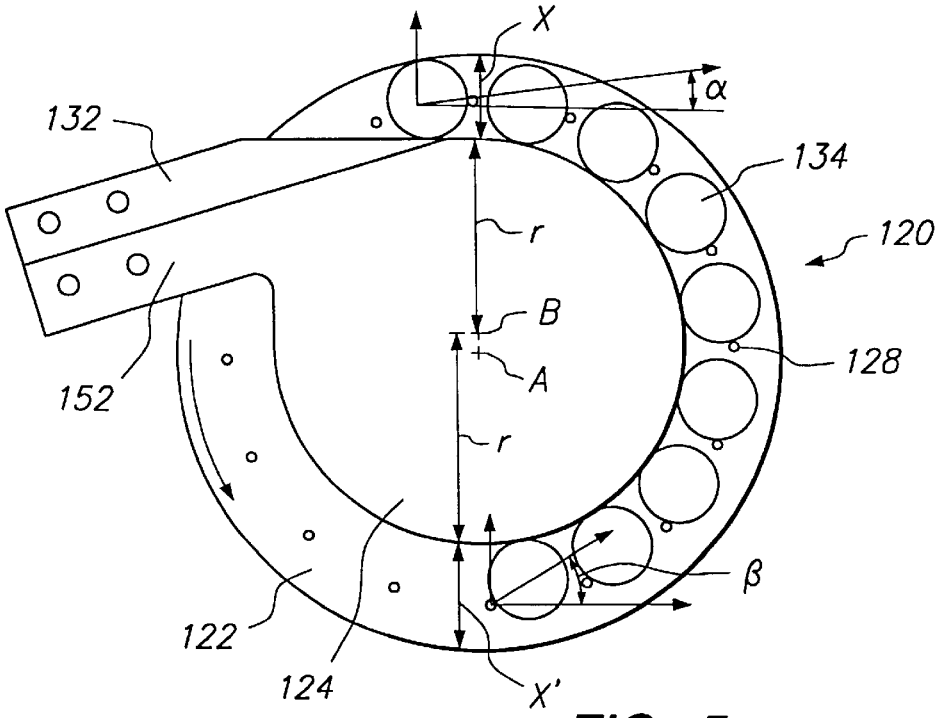
FIG. 5 is a front view of a coin feeder mechanism in accordance with an embodiment of the present invention.

However, the shelfwheel 124 has a centerline C2 (not illustrated) extending therethrough perpendicular to the front and rear surfaces 146,148, which centerline C2 is offset from the axis C1. When viewing the front surface 146 of the shelfwheel 124, as illustrated in FIG. 5, the axis C1 passes through a point A, which the centerline C2 passes through a point B. The point B is considered the center point in that it is equidistant from the peripheral edge 150 (excepting the area of the mounting arm 152), in this case a radial distance "r."

Importantly, point B is desirably positioned vertically above point A when the shelfwheel 124 is mounted with respect to the pinwheel 122. Thus, the axis C1 is not coincident with the centerline C2 which passes through the center of the shelfwheel 124. As a result, the peripheral edge 150 of the shelfwheel 124 is closer to the peripheral edge 140 of the pinwheel 122 at the top than at the bottom. As illustrated, the distance between the peripheral edge 140 of the pinwheel 122 and the shelfwheel 124 at the top and bottom is X and X', respectively, where X'>X. Because the pins 128 are mounted generally the same radial distance from the centerline C1 of the pinwheel 122, the distance between the peripheral edge 140 of the pinwheel 122 and the pins 128 at the bottom is thus correspondingly larger or greater than the corresponding distance at the top.

Of course, since the pins 128 are mounted in fixed radial position on the pinwheel 122, the peripheral edge 150 of the shelfwheel 124 from the pins 128 on the pinwheel 122 at the top is less than the distance from the peripheral edge 150 of the shelfwheel 124 from the pins 128 on the pinwheel 122 at the bottom.

When considering an engaged coin 134 at the bottom or "coin pick-up area" of the feeder mechanism 120, a contact angle $\beta$ is formed. As illustrated, the contact angle $\beta$ represents the angle between horizontal and the direction of contact force (i.e. a "normal" direction, or one perpendicular to the plane of engagement between the pin and coin) between a pin 128 and a coin 134 at the bottom of the mechanism. This angle $\beta$ is generally fairly large, at least in relation to such an angle in a prior art configuration. This means that a substantial component of the force applied by the rotating pin 128 against the coin 134 is in the vertical direction. In other words, the pin 128 is acting to "pick-up" the coin 134 to move it from the hopper towards the top of the mechanism.

On the other hand, when considering an engaged coin 134 at the top of the feeder mechanism 120, a contact angle $\alpha$ is formed. As illustrated, the contact angle $\alpha$ represents the angle between horizontal and the direction of contact force between a pin 128 and a coin 134 at the top or "coin delivery area" of the mechanism. This angle $\alpha$ is generally small, generally being smaller than the angle $\beta$. This means that the majority of the force applied by the rotating pin 128 against the coin 134 at this location is in the horizontal direction. In other words, the pin 128 is acting to push the coin 134 laterally in this location. Since the majority of the force in this location is a translating force, little of the force applied to the coin 134 in this location is in the vertical direction.

The particular offset distance of the shelfwheel 124 relative to the pinwheel 122 and the pins 128 thereon may vary. In a preferred embodiment, the shelfwheel 124 is offset a distance such that when a coin 134 is at the delivery area, the angle $\alpha$ is near zero (0) degrees, or in other words, at the coin delivery area the pins 128 generally contact the coins 134 in a manner transmitting a force in only a horizontal direction. In accordance with the invention, however, the orientation of the shelfwheel 124 and pinwheel 122 may be such that the pins 128 engage the coins 134 at an angle $\alpha$ which is greater than zero (0) degrees, or even less than zero (0) degrees (i.e. the transmitted force actually transmits a force having a vertical (upward) component and a horizontal component).

The selection of an angle of zero (0) degrees may be used in order to generate an offset distance. Of course, it may then be desirable to consider the orientation of the pins 128 relative to the coins 134 at the pick-up area to accomplish the above-stated purposes of the invention in facilitating and improving coin pick-up. If the orientation at the pick-up area is less than optimal, it may be desirable to adjust the first selected offset distance to maximize the angles of contact at both the pick-up and delivery areas.

Figure 1:
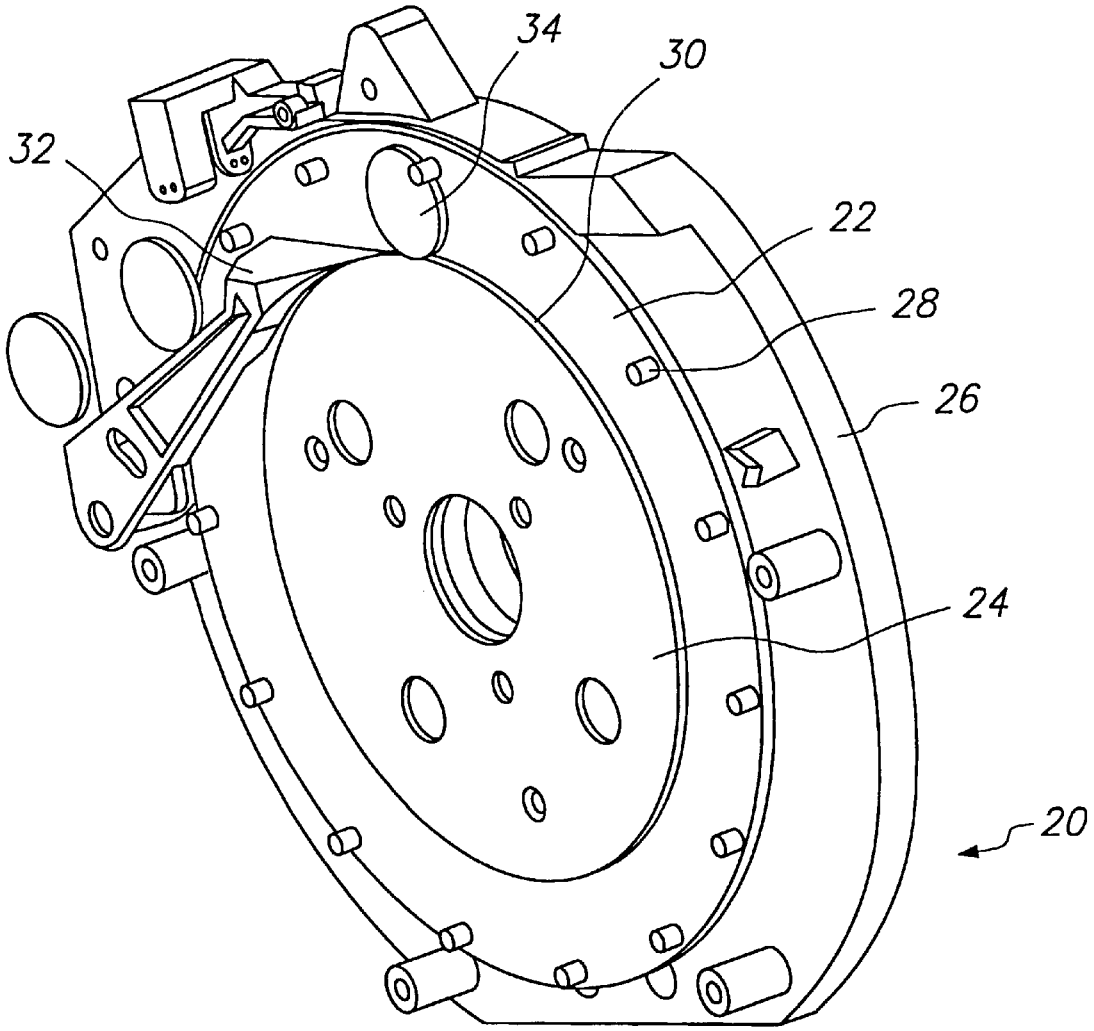
FIG. 1 PRIOR ART
FIG. 1 is a perspective view of a coin feeder mechanism for a coin hopper in accordance with the prior art.
Figure 2:
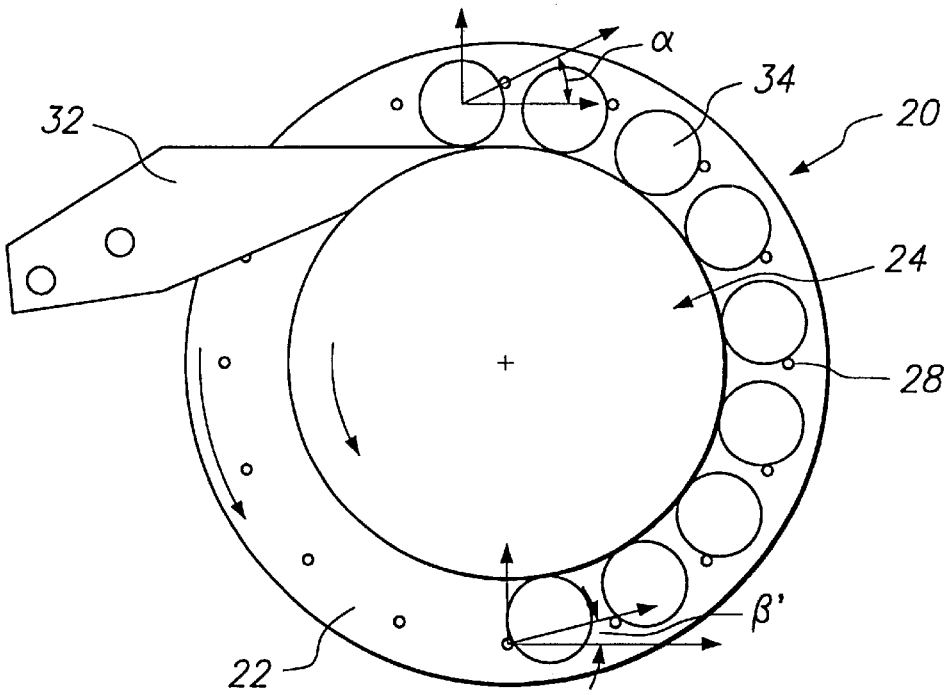
FIG. 2 PRIOR ART
FIG. 2 is a front view of the coin feeder mechanism of the prior art.

The benefits of the arrangement of the coin feeding mechanism 120 of the present invention become more apparent when considering the arrangement of the prior art. FIG. 2 illustrates a mechanism of the prior art in which a circular shelfwheel 24 is mounted for concentric rotation with a circular pinwheel 22. In such an arrangement, the distance between the peripheral edge of the shelfwheel 24 and the pinwheel, and thus the pins 28 thereon, is constant.

In the prior art arrangement, the angle of contact $\beta'$ at the bottom of the device is very small. The force applied by the pin 28 upon a coin 34 at this location is substantially in the horizontal direction, pushing the coin. In this arrangement, the pins 28 at the bottom of the pinwheel 22 tend to push coins outwardly from the device, and not pick-up the coins.

Further, the angle of contact $\alpha'$ at the top of the device is large. The force applied by the pin 28 upon a coin 34 at this location includes a substantial vertical component. This vertical component acts to push the coin 34 down at the location of the knife 32. This causes the coin to jam, in that the coin is driven downwardly where the knife 32 meets the shelfwheel 24.

In accordance with the present invention, the configuration of the coin feeder mechanism 120 is such that (1) the pins 128 when at the coin pick-up area of the device aid in picking up the coins 134; and (2) the pins 128 when at the coin delivery area of the device are arranged to push the coins 134 onto the knife 132 and out of engagement with the shelfwheel 124. The distance by which the shelfwheel 124 is offset from the pinwheel 122 in the present invention determines the extent to which the relationship of the pins 128 and coins 134 at the top and bottom of the mechanism 120 is changed.

The present invention includes a method of transporting coins from a hopper with a coin feeder mechanism 120. The method comprises rotating the pinwheel 122 with respect to the shelfwheel 124. As the pinwheel 122 rotates, coins 134 in the hopper 121 (see FIG. 3) are aligned with the pinwheel 122. A coin 134 enters the space between each pair of pins 128, the coin 134 resting against the front face 136 of the pinwheel 122.

As described above, when a coin 134 is picked up, a pin 128 acts upon the coin 134 to both translate it (i.e. move it in a horizontal direction) along the shelfwheel 124, and raise it upwardly. As illustrated in FIG. 5, as the coin 134 moves around the shelfwheel 124 from the bottom towards the top, the pin 128 serves to cradle the coin 134, preventing it from falling back into the coin hopper 121.

The coins 134 are transported around the shelfwheel 124 by action of the pins 128 upon the coins 134 causing the coins to slide or rotate along the peripheral surface 150 of the stationary shelfwheel 124. Once a coin 134 reaches the top of the shelfwheel 124, the coin 134 is pushed onto the knife 132. As described above, as the coins 134 move to the top of the shelfwheel 124, they are moved upwardly towards the pins 128. Then, each pin 128 is in a position in which it generally pushes or translates the coin 134 onto the knife 132. Because the coin 134 is being pushed generally horizontally and is not being pushed downwardly, the coin 134 moves onto the knife 132 smoothly without jamming. The coin 134 then travels along a coin delivery path defined by the knife 132 to another location.

An advantage of the present invention is that because the shelfwheel 124 does not rotate, the knife 132 can be formed integrally therewith. This eliminates any gap between the knife 132 and shelfwheel 124 where the knife engages the shelfwheel. Because there is no gap between these elements, the transported coins are not susceptible to becoming jammed at a discontinuity at the interface between these elements.

A variety of other configurations for accomplishing the effect of the present invention are contemplated. A number of configurations may be used for mounting the shelfwheel 124 with respect to the pinwheel 122. For example, in another arrangement, the shelfwheel is mounted on a stationary support shaft and the pinwheel is mounted in rotating fashion about the stationary shaft.

Another arrangement for changing the position of the pins on the pinwheel relative to the peripheral edge of the shelfwheel at the coin pick-up and delivery locations comprises moving the pins themselves. For example, each pin may be permitted to move along a radial slot in the pinwheel. A cam-mechanism is associated with the pins (such as at the rear face 138) of the pinwheel which causes the pins to be pressed inwardly along their slot when the pin reaches the top position (i.e. the pins move closer to the shelfwheel at the coin delivery area). A spring, cam or other mechanism may be provided for returning the pin outwardly along the slot when the pin reaches the bottom position (i.e. the pins move farther from the shelfwheel at the pick-up area).

In or more embodiments, the shelfwheel 124 may be generally circular, but arranged to include a rise or other area extending outwardly therefrom a greater distance from a center thereof at the top portion or other coin delivery area. In this arrangement, the distance from the peripheral edge 150 of the shelfwheel 124 to the pins 128 is generally constant (even considering a bottom portion) except at a top or coin delivery thereof. In this arrangement, no coin pick-up benefits are achieved over the prior art, but the above-stated advantages of preventing of coin jamming are realized.

As illustrated in FIG. 4, the coin feeder mechanism 120 may be provided with an agitator 170. As is known, agitators are useful in moving or "stirring" the coins in the hopper and aiding in the alignment of the coins for pickup by the feeder mechanism. In one or more embodiments, an agitator 170 is mounted at the front face 146 of the shelfwheel 124.

In one or more embodiments, the agitator 170 has a generally planar body with a number of fingers 172 extending therefrom. As illustrates, the body has three arms, each of which has an associated finger 172. Each finger 172 comprises member extending outwardly from a front surface of the body for engagement with coins 134 located in a coin hopper. Of course, the agitator 170 may have a variety of shapes and configurations.

Preferably, the agitator 170 is arranged to rotate. In one embodiment, the agitator 170 is mounted on the drive shaft 142 and permitted to rotate with respect to the shelfwheel 124.

Of course, the coin feeder mechanism 120 may include a variety of other apparatus. For example, a coin swiper may be provided for swiping off layered coins, i.e. one of two coins positioned on top of one another being transported by the mechanism.

While the method and apparatus of the present invention have been described with reference to the pick-up and transport of coins, those of skill in the art will appreciate that the invention may be used with other items. Such items include tokens, chips and other generally disc-shaped bodies.

It will be understood that the above described arrangements of apparatus and the method therefrom are merely illustrative of applications of the principles of this invention and many other embodiments and modifications may be made without departing from the spirit and scope of the invention as defined in the claims.

I claim:

1. A coin feeder mechanism for transporting coins from a hopper comprising:

a shelfwheel having a peripheral edge;

a pinwheel having a front face and a peripheral edge;

a plurality of pins extending from said front face of said pinwheel between said peripheral edge of said pinwheel and said peripheral edge of said shelfwheel;

said pinwheel rotatably mounted with respect to said shelfwheel and adjacent thereto, said shelfwheel having a coin pick-up area and a coin delivery area, said peripheral edge of said shelfwheel at said coin pick-up area being farther away from pins associated with the pinwheel at said coin pick-up area than the peripheral edge of said shelfwheel is to pins associated with the pinwheel at said coin delivery area.

2. The coin feeder mechanism in accordance with claim 1 wherein said pinwheel has a center point and said shelfwheel has a center point and said center point of said shelfwheel is offset from said center point of said pinwheel.

3. The coin feeder mechanism in accordance with claim 2 wherein said center point of said shelfwheel is offset vertically upward from said center point of said pinwheel.

4. The coin feeder mechanism in accordance with claim 1 including a knife, said knife having a portion adapted to receive coins from said shelfwheel.

5. The coin feeder mechanism in accordance with claim 1 wherein said pinwheel is rotatably mounted on a drive shaft.

6. The coin feeder mechanism in accordance with claim 5 wherein said shelfwheel is mounted on said drive shaft in a manner permitting said drive shaft to rotate with respect thereto.

7. The coin feeder mechanism in accordance with claim 1 wherein said pins are located approximately the same radial distance from a center of said pinwheel.

8. The coin feeder mechanism in accordance with claim 1 wherein said peripheral edge of said shelfwheel is positioned a greater distance from pins on said pinwheel at said coin pick-up area than at a position between said coin delivery and coin pick-up areas.

9. The coin feeder mechanism in accordance with claim 1 wherein said peripheral edge of said shelfwheel is positioned a lesser distance from pins on said pinwheel at said coin delivery area than at a position between said coin delivery and coin pick-up areas.

10. A coin feeder mechanism for transporting coins from a hopper comprising:

a shelfwheel having a front face, a rear face and a peripheral edge;

a pinwheel having a front face and a rear face, and a peripheral edge, said pinwheel mounted for rotation with respect to said shelfwheel;

a plurality of pins extending outwardly from said front face of said pinwheel between said peripheral edge of said shelfwheel and said peripheral edge of said pinwheel;

said peripheral edge of said shelfwheel located closer to said pins at a first location of said shelfwheel than at a second location thereof; and said rear face of said shelfwheel mounted adjacent said front face of said pinwheel such that said pins of said pinwheel transport coins along at least a portion of said peripheral edge of said shelfwheel.

11. The coin feeder mechanism in accordance with claim 10 wherein said pinwheel is generally circular and arranged to rotate about a first axis, and wherein said shelfwheel is generally circular and has a second axis offset from said first axis.

12. The coin feeder mechanism in accordance with claim 10 wherein said peripheral edge of said shelfwheel is separated from said pins at a top portion of said shelfwheel by a distance D1 and is separated from said pins at a bottom portion of said shelfwheel by a distance D2, said distance D2 greater than said distance D1.

13. The coin feeder mechanism in accordance with claim 10 including a knife, said knife defining a coin transporting surface and cooperating with said shelfwheel to transport coins therefrom.

14. The coin feeder mechanism in accordance with claim 13, wherein said peripheral edge of said shelfwheel is positioned nearer said pins at a location adjacent said knife than at a location generally opposite therefrom.

15. The coin feeder mechanism in accordance with claim 10 wherein said pinwheel is rotatably mounted on a drive shaft and said shelfwheel is mounted in stationary position on said drive shaft.

16. A coin feeder mechanism for transporting coins from a coin hopper comprising:

a pinwheel mounted for rotation about a first axis, said first axis extending through a center of said pinwheel;

a shelfwheel, said shelfwheel having a second axis extending through a center thereof, said second axis offset from said first axis; and a plurality of pins extending from said pinwheel for use in transporting coins along said shelfwheel.

17. The coin feeder mechanism in accordance with claim 16 wherein said second axis is positioned vertically upwardly from said first axis.

18. The coin feeder mechanism in accordance with claim 16 wherein said shelfwheel is mounted stationary with respect to said pinwheel.

19. The coin feeder mechanism in accordance with claim 18 wherein said pinwheel and shelfwheel are mounted on a rotating drive shaft.

20. The coin feeder mechanism in accordance with claim 16 wherein said second axis is offset in a direction towards a coin delivery area of the mechanism.

* * * * *